US006626200B1

(12) United States Patent
Reedy

(10) Patent No.: US 6,626,200 B1
(45) Date of Patent: Sep. 30, 2003

(54) THERAPEUTIC WALKING AID

(76) Inventor: Shirley M. Reedy, 45 Vivian Dr., East Fallowfield, PA (US) 19320-4600

( * ) Notice: Subject to any disclaimer, the term of this patent is extended or adjusted under 35 U.S.C. 154(b) by 221 days.

(21) Appl. No.: 09/281,553

(22) Filed: Mar. 30, 1999

(51) Int. Cl.[7] ..... A61H 3/04

(52) U.S. Cl. ..... 135/67; 135/912; 280/1.5; 482/68; 297/5

(58) Field of Search ..... 135/67, 912; 280/1.5; 482/66, 68; 297/5

(56) References Cited

U.S. PATENT DOCUMENTS

| | | | | | |
|---|---|---|---|---|---|
| 2,282,689 | A | | 5/1942 | Ames | |
| 2,362,466 | A | | 11/1944 | Carter | |
| 2,596,055 | A | * | 5/1952 | Thomas | |
| 2,981,312 | A | * | 4/1961 | Sundberg | |
| 3,398,974 | A | * | 8/1968 | Edwards et al. | |
| 3,405,954 | A | * | 10/1968 | Wolfe | |
| 3,455,313 | A | * | 7/1969 | King | |
| 4,312,505 | A | * | 1/1982 | Englehart | |
| 4,314,576 | A | | 2/1982 | McGee | |
| 4,411,283 | A | * | 10/1983 | Lucarelli | 135/67 |
| 4,474,202 | A | * | 10/1984 | Blechner | 135/675 |
| 4,621,804 | A | | 11/1986 | Mueller | |
| 5,224,717 | A | | 7/1993 | Lowen | |
| 5,271,422 | A | | 12/1993 | Sorrell et al. | |
| 5,347,666 | A | | 9/1994 | Kippes | |
| 5,443,304 | A | * | 8/1995 | Fochs | 135/67 X |
| 5,509,152 | A | * | 4/1996 | Kippes | 135/67 X |
| 5,605,169 | A | | 2/1997 | Light | |
| 5,657,783 | A | * | 8/1997 | Sisko et al. | 135/67 |
| 5,741,020 | A | * | 4/1998 | Harroun | |
| 5,803,103 | A | * | 9/1998 | Haruyama | 135/67 |

* cited by examiner

*Primary Examiner*—Robert Canfield
(74) *Attorney, Agent, or Firm*—RatnerPrestia

(57) ABSTRACT

A therapeutic walking aid is adapted to support a patient in an upright position The walking aid includes side portions at least partially defining an open interior space sized to accommodate the patient. The walking aid includes elongated arm supports extending along side portions of the walking aid and a back support extending upwardly to an elevation above the arm supports and extending across a back portion of the walking aid. The arm supports cooperate with the back support in order to provide support for a patient's arms and upper body. The walking aid can be adapted to be wheelchair accessible in order to facilitate a patient's transfer from the walking aid to a wheelchair in a safe and efficient manner. The walking aid includes a releasable support system as well.

18 Claims, 12 Drawing Sheets

THERAPEUTIC WALKING AID

FIELD OF THE INVENTION

This invention relates to an improved walking aid and, in particular, to a walking aid adapted to support a patient during physical therapy.

BACKGROUND OF THE INVENTION

In the fields of rehabilitation medicine and physical therapy, it is well known that a variety of motor disturbances can result from traumatic brain injury (TBI). Among them are paralysis or paresis which can involve isolated muscle groups, limb combinations, or the entire body. For example, disorders of balance and coordination can result from damage to the cerebellum or its connections. Even those patients with good muscle strength may therefore be unable to ambulate owing to profound ataxia, which is the dysfunctional gait that results from the brain's failure to regulate posture as well as the strength and direction of limb movements. Ataxia is, unfortunately, very difficult to treat.

It is also well known that patients who have suffered a debilitating stroke often have severely compromised ambulation. When a patient becomes hemiplegic following a stroke, the central motor and the sensory tracts are disrupted. Most patients with hemiplegia exhibit very primitive pattern motion whenever there is serious impairment of selected motor control. Such primitive pattern motion makes difficult forward progression as well as body transfer from one position to another. The transfer from a standing position to a walking gait is especially difficult because, added to the demands of balance, is the task of lifting the body's weight with each step. Until a patient can attain a standing position without the aid of another, that patient is not an independent walker.

For victims of stroke, most patients eventually ambulate with assistive devices, and the physical therapist will need to use a variety of progressive activities and equipment aimed toward independent ambulation. For example, parallel bars have been used for sitting, standing, walking, and balance activities, which are prerequisites for functional transfers and ambulation. However, even well-meaning attendants have been known to report a patient to be ambulating when actually the patient is being essentially dragged by two attendants, unable to advance his or her extremities independently. Hemiplegic patients lacking independent ambulation may be provided with a hemiplegic wheelchair. The goal however is to facilitate the transfer from such a chair to a walking position so that the patient can progress towards independent ambulation. Presently, waist-high walkers, quad-canes or straight canes are conventionally employed when the patient becomes more advanced.

Walking aids or "walkers" have been used for many years by the elderly for support while walking and for protection against falling. During the use of such conventional walkers, which requires full upper body mobility, strength, and coordination, a person moves forward by picking up the walker frame and moving it forward a short distance so that a step or two can be taken until the process is repeated. Such conventional walkers are not, however, well adapted for therapeutic use with patients who have suffered severe trauma such as those patients who have suffered tragic TBI or a debilitating stroke. Such patients must undergo rigorous physical therapy in order to relearn various aspects of physical development, including standing and walking patterns, in order to provide a transition from a wheelchair to independent ambulation. Therapeutic sessions are often used in order to "pattern" the walking function while the patient is maintained in an upright position. The therapeutic session usually concentrates on the movement of the patient's lower body and moves the patient's legs while immobilizing and securing the upper body of the patient.

Therapeutic rehabilitation of patients who have suffered TBI or stroke beneficially begins once the patient is able to stand with assistance so that walking and standing patterns can be reestablished. Therapeutic rehabilitation of TBI patients, for example, conventionally requires the assistance of two or three rehabilitation specialists to facilitate a one-half to one hour session. Conventional walking aids do not adequately support the patient in the upright position with adequate upper-body support so that a therapist can attend to guidance of the patient's lower body.

Moreover, conventional rehabilitation of larger adult patients is limited due to the risk of injury to hospital staff members. It has been discovered that rehabilitation patients undergoing strenuous therapeutic sessions can quickly or even suddenly become physically exhausted and unable to support themselves. This is particularly true with patients suffering ataxia as the result of TBI. Such exhaustion also occurs in connection with patients who have suffered debilitating strokes. When such exhaustion occurs, the patient is likely to collapse partially or completely as he or she becomes unable to provide any self-support. For this reason, it is often necessary to make a sudden transfer of the patient from the standing position to a wheelchair. Transfers of this kind have been very difficult in the past because therapeutic aids often interfere with the transfer if they come between the patient and the wheelchair. Also, conventional aids fail to adequately support the patient while waiting for such a transfer.

Over the years, various attempts have been made to provide improved walking aid devices. U.S. Pat. No. 5,224,717 to Lowen describes a walking aid device which is said to allow a user to retain a full upright position while providing continuous support of a portion of the user's body weight. The Lowen device includes a rib rest means disposed in a plane slightly below the plane of armrests.

U.S. Pat. No. 5,347,666 to Kippes describes a transfer aid device for assisting people to rise from a seated position into a standing position. The Kippes device includes a grasping portion having two shafts for the patient to clutch and pull on when rising into a standing position.

U.S. Pat. No. 5,605,169 to Light discloses a collapsible walker with a retractable seat. When the user wishes to rest, the seat can be moved from its stored or horizontally retracted position to a vertical position by pushing the seat downward.

U.S. Pat. No. 5,271,422 to Sorrell et al. discloses a front entry safety walker having a porous seat to accommodate incontinent patients. The Sorrell walker also includes a rear wheel mechanism. A top of the rear frame is bent away from the patient.

U.S. Pat. No. 4,314,576 to McGee discloses an apparatus composed of a number of tubular elements formed into a frame. A person in a wheelchair may approach the frame and pull himself or herself into position within the frame to stand, to walk, and to exercise without the assistance of other persons.

Despite these numerous attempts to provide an improved walking aid system, none of the conventional walkers are suitably adapted for therapeutic support of persons who have suffered TBI or stroke, wherein the patient is supported during a therapeutic session in such a way that ambulation can be patterned by a therapist while the patient's upper body is supported.

SUMMARY OF THE INVENTION

This invention provides a therapeutic walking aid having spaced apart side portions that partially defme an interior space which can be occupied by a patient to support the patient in an erect position. The walking aid is specifically adapted for use by patients, such as those that have suffered ataxia, TBI or a debilitating stroke, during rehabilitation and relearning of the standing and ambulation functions.

The walking aid according to this invention includes side portions spaced from one another to defme an open interior space sized to accommodate the patient. Each side portion includes an arm support. The walking aid also includes a back portion extending between the side portions. The back portion of the walking aid includes a back support extending upwardly to an elevation above the arm supports.

In one preferred embodiment of the invention, the back portion of the walking aid defines a back opening that is sized and shaped to permit wheelchair access into the interior space of the walking aid. In this embodiment, a wheelchair can be at least partially introduced into the interior space of the walking aid through the back opening to receive a patient for removal from the interior space. Wheelchair accessibility has been discovered to facilitate the transfer of a patient from the walking aid into the wheelchair at the end of a therapeutic session in a safe and efficient manner.

According to another aspect of the invention, wheels are provided for mobility of the walking aid with respect to the floor. When viewed from above according to one aspect of the invention, the walking aid has a substantially U-shaped configuration with an open front portion to facilitate ingress and egress of a patient into and out from the interior space of the walking aid. Such a preferred configuration has been discovered to securely brace the upper body of the patient so that ambulatory functions can be patterned by a physician or therapist without requiring the physician or therapist to support the patient's upper body.

DETAILED DESCRIPTION OF THE INVENTION

Figure 1:
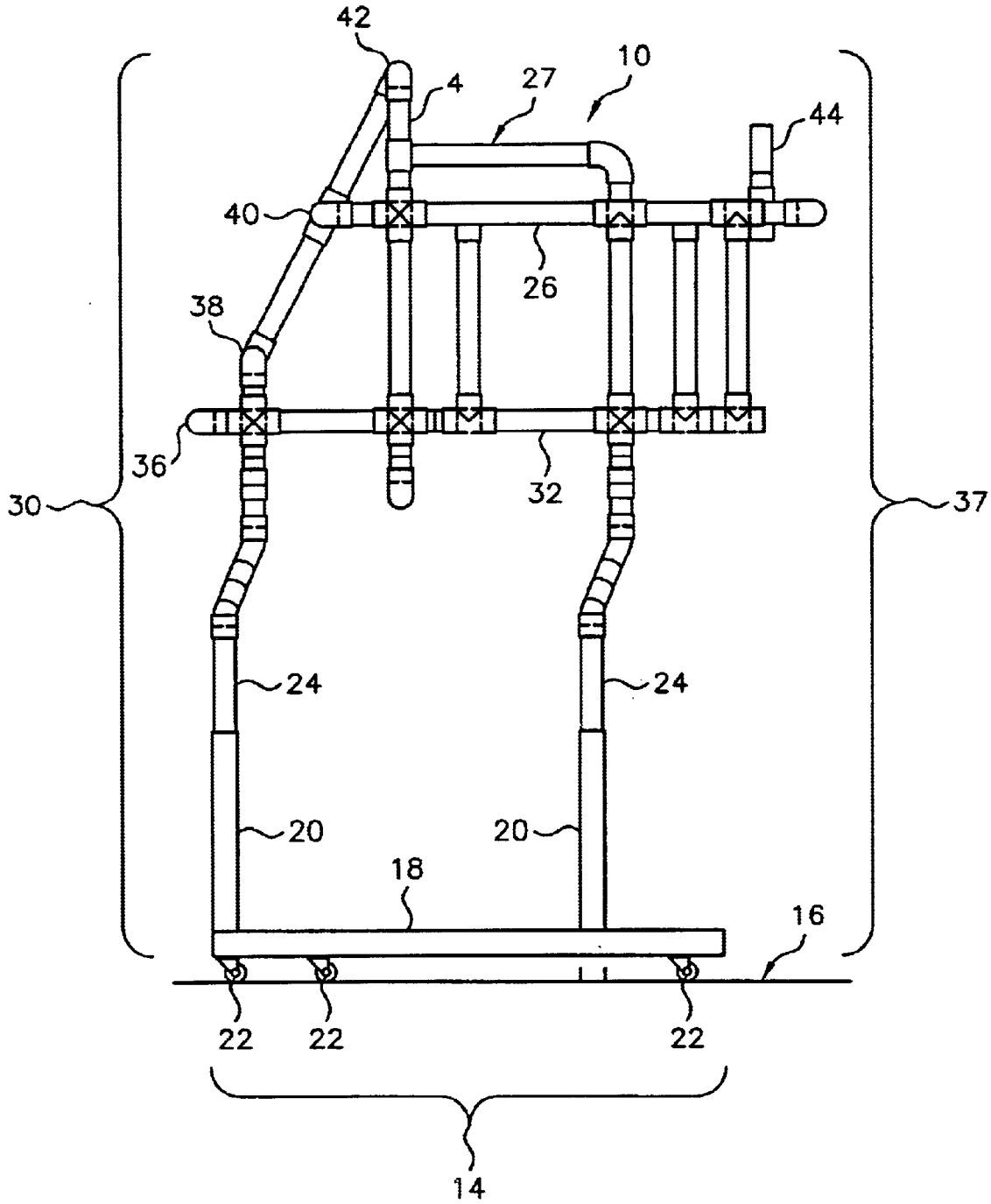
FIG. 1 is a side view of an embodiment of a therapeutic walking aid according to this invention.

The invention will now be described with reference to several embodiments selected for illustration in the drawings. It will be appreciated that this invention is not limited to the particular embodiments shown and described herein. Instead, the scope of the invention will be defined separately in the appended claims. Also, it will be appreciated that the drawings are not made to a particular scale or proportion.

Generally, a therapeutic walking aid according to this invention is particularly adapted to support a patient in an upright and erect position during a therapeutic session. The walking aid is sized and configured to provide a patient with significant upper body support throughout each therapeutic session so that physicians, physical therapists or other technicians can focus their attention and expertise on the patient's progress with regard to ambulation and standing functions. By use of a therapeutic walking aid according to this invention, it has been discovered that a therapeutic session lasting as long as one hour can be conducted by a single rehabilitation staff member as opposed to two or three staff members.

In order to provide the necessary support of the patient's upper body, the therapeutic walking aid includes a structural frame that defines an interior space in which the patient is positioned during therapy. The frame includes a pair of arm supports that extend longitudinally along side portions of the frame to support a patient's forearms. Use of the walking aid does not require the function of both arms of the patient. At a back portion of the frame, and extending upwardly to an elevation above the arm supports, is a back support portion of the frame. The back support extends across the back portion of the frame just behind the patient's back just below the patient's shoulders.

The arm supports and the back support cooperate to provide support for the patient's arms as well as the patient's upper body when the patient is positioned within the interior space defined by the frame. It is this arm and upper body support that maintains the patient in the upright position throughout the therapeutic session while permitting a specialist to focus on the lower body movement of the patient in order to reteach ambulation and to pattern the movements necessary for walking. Also, a U-shaped configuration of the walking aid can provide full support for the patient and protect the patient while allowing for release of the patient for transfer to a wheelchair, when necessary.

The therapeutic walking aid includes as a part of the frame a base portion that supports the frame with respect to a floor surface. In order to facilitate movement of the therapeutic walking aid across the floor surface, the base portion of the frame may be optionally provided with wheels.

Exemplary details of one embodiment of a therapeutic walking aid according to this invention will now be described with general reference to FIGS. 1–4, which provide side, front, back and top views of the walking aid, respectively. The therapeutic walking aid, generally designated by the numeral 10, includes a structural framework that at least partially defines an interior space 12. Walking aid 10 has a base portion 14 configured to support the remainder of the frame with respect to a floor surface 16. Base portion 14 is optionally a separable assembly that is adapted for releasable or permanent connection to the remainder of walking aid 10 as in the illustrated embodiment or base portion 14 can be an integral portion of walking aid 10.

Base portion 14 includes elongated side members 18 that extend along side portions of the frame (only one shown in FIG. 1). Extending upwardly from elongated side members 18 are a series of vertically-extending supports 20. In this embodiment, four vertically-extending supports 20 are utilized although only two are visible in FIG. 1. The supports 20 are preferably hollow or tubular in shape so that they can receive leg portions of the frame as will be described later. Base portion 14 also includes a plurality of wheels 22 connected to the bottom of the elongated side members 18. These wheels 22 permit easy movement of walking aid 10 along floor surface 16, if needed. Wheels 22 are optional and permit movement of the walking aid.

Received within vertically-extending supports 20, and extending upwardly above supports 20 toward an upper portion of walking aid 10, are four elongated leg members 24. Toward an upper portion of the frame of walking aid 10 are provided a pair of elongated side members 26 which act as arm supports or arm rests for a patient that is positioned within interior space 12. The elevation of elongated side members 26 is selected so that the arm supports 26 can be used by the patient to help support the patient's upper body. The arm supports 26 are located along side portions 28 of walking aid 10. Arm supports 26 extend rearwardly from the front of walking aid 10 towards a back portion 30. Each arm support 26 has an outer support member 27 connected between arm supports 26 and a vertical member. Outer support members 27 restrict the movement of a patient's elbows and forearms. By confining the patient's elbows and forearms, the patient is able to maintain a better sense of balance and a proper center of gravity.

Provided at an elevation below arm supports 26, and also extending along side portions 28 of walking aid 10, are elongated side members which provide handholds at hip level also for use by the patient for supporting his or her upper body during a therapeutic session. Handholds 32 in this embodiment are substantially parallel to arm supports 26 and are provided at an elevation suited for grasping by the patient's hand or hands at the patient's hip level when the patient is in the upright position.

The base portion of walking aid 10 also includes a lower back member 34 that is elongated to extend across back portion 30 of walking aid 10. Lower back member 34 extends between a pair of elongated leg members 24 at the back portion 30 of base portion 14. As will be described later with reference to a second embodiment of a walking aid according to this invention, lower back member 34 can be pivotable, removable or otherwise movable with respect to the remainder of base portion 14. A wheel 22 is preferably provided along the length of lower back member 34 (FIG. 2) if wheels are used at base portion 14 for mobility along floor surface 16.

Also extending across the back portion 30 of walking aid 10 is an elongated back member 36 positioned at the same elevation as handholds 32. Above back member 36 is another elongated back member 38 that acts as a cross bar extending between the side portions 28 of the frame of walking aid 10. Above cross bar 38, and in substantially the same plane as arm supports 26, is another elongated back member 40. Yet above back member 40 at a top portion of the frame of walking aid 10 is an upper back member 42 that extends across the back portion 30 of walking aid 10, extending across the space defined between the side portions 28 and elongated leg members 24 of walking aid 10. Back members 4 extend downwardly from upper back member 42 for connection to outer support members 27, arm supports 26, and handholds 32 on each side of walking aid 10, thereby providing a surface against which the patient's arms and/or back can be braced.

Generally speaking, at least one of the elongated back members 4, 38, 40, 42 cooperates with the arm supports 26 to support a patient in the upright position within the interior 12 of walking aid 10 during therapeutic use. A patient may have sufficient upper body strength to hold himself or herself upright within walking aid 10 during therapeutic sessions merely by grasping the handholds 32 or leaning on arm supports 26 and by bracing his or her upper body against one or more of the elongated back members 4 and 42. If necessary, however, various additional components can be used in order to brace a patient within interior 12 of walking aid 10 by attachment of additional components which will be described later. Such components are particularly beneficial when the patient does not have upper body strength or use of both arms.

Figure 2:
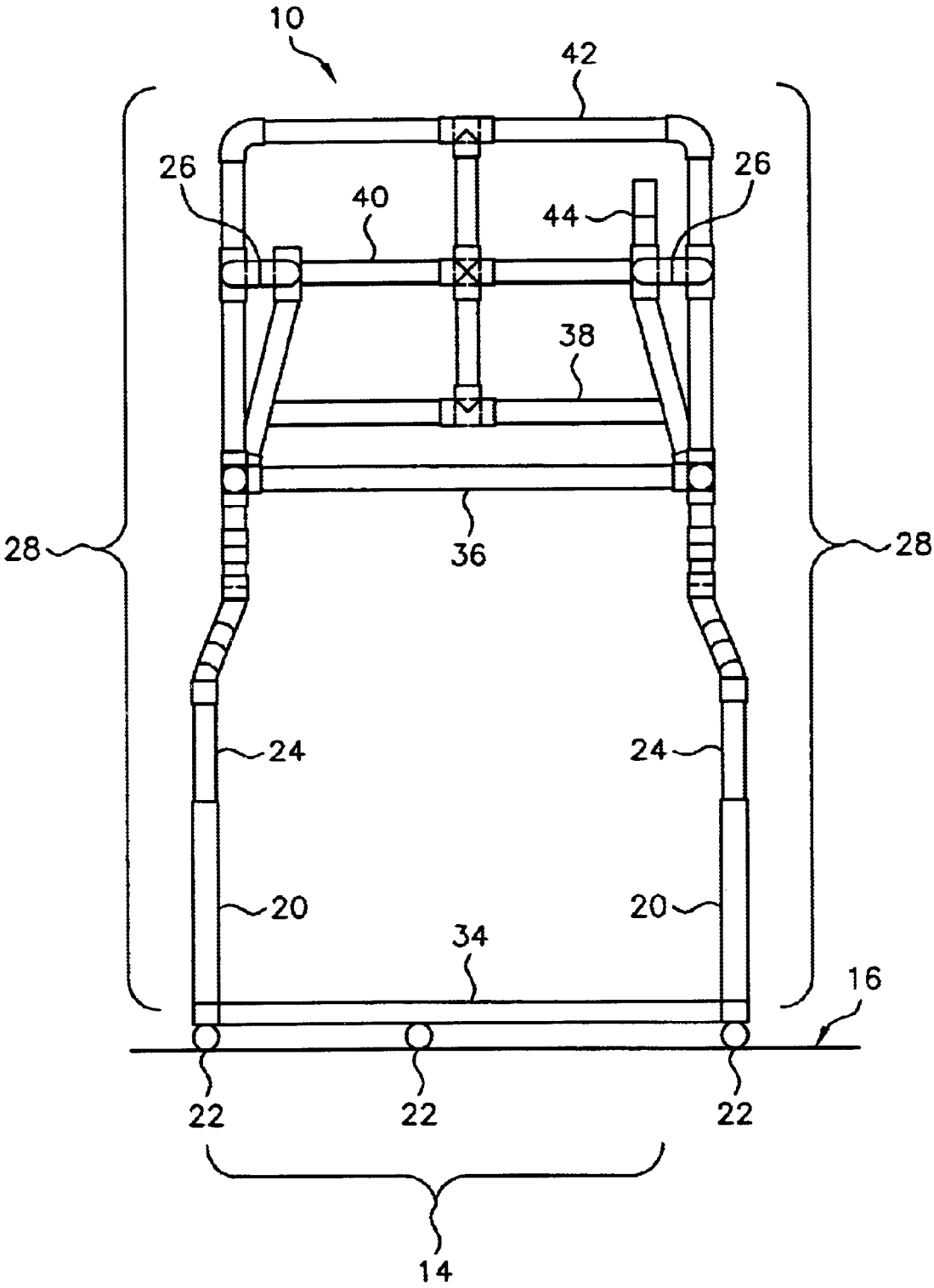
FIG. 2 is a front view of the therapeutic walking aid illustrated in FIG. 1.
Figure 3:
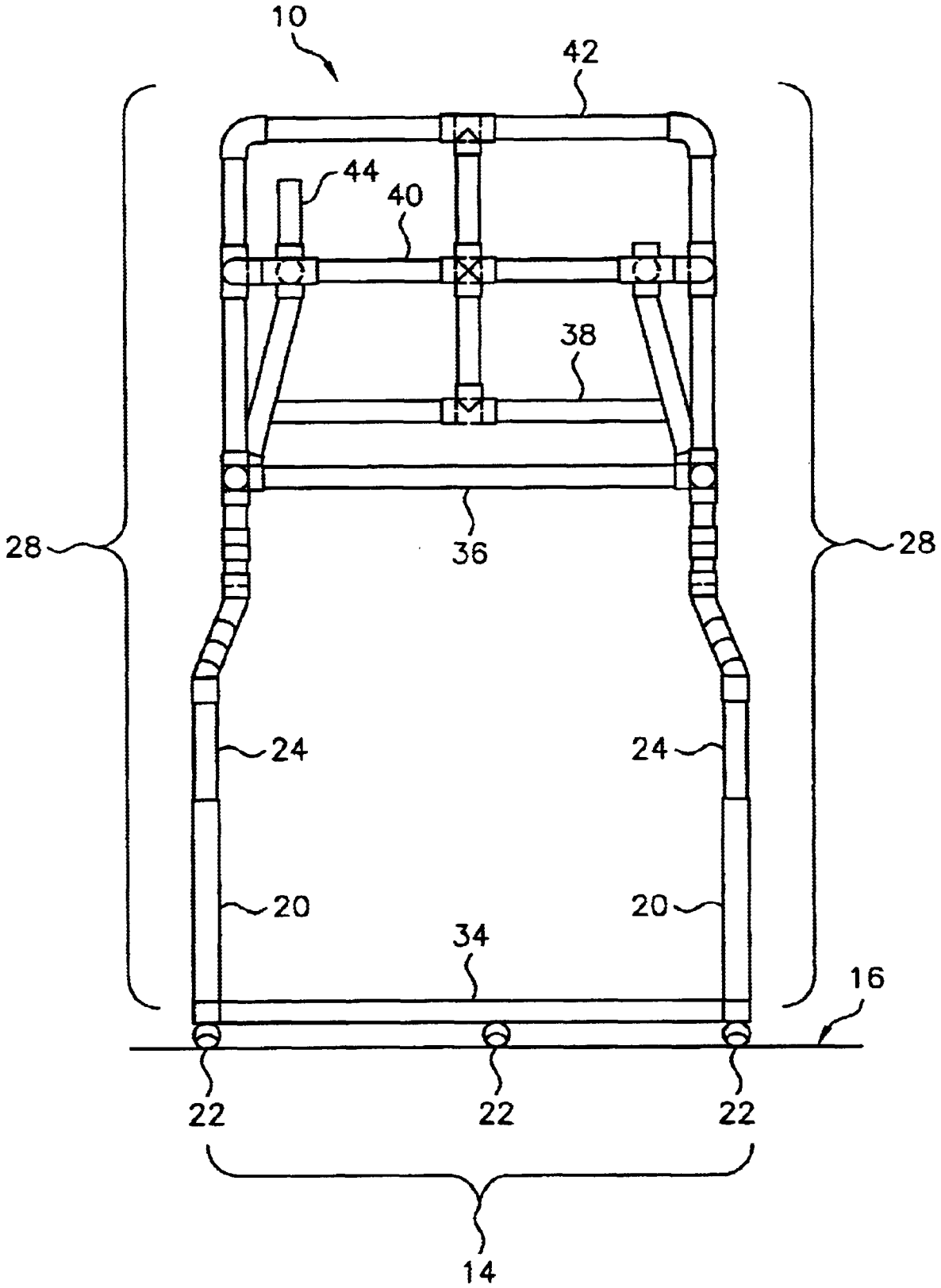
FIG. 3 is a rear view of the therapeutic walking aid illustrated in FIG. 1.

As is illustrated in FIGS. 1–3, this walking aid embodiment 10 also includes a hand grip 44 that extends upwardly with respect to the upper surface of arm supports 26 toward a front portion of walking aid 10. As will be described later, hand grips 44 (only one shown in the figures) can be removably connected to arm supports 26 for removal and/or replacement. A structure such as hand grip 44 can be removably or permanently attached to one or both of the arm supports 26 at a location selected so that it can be easily grasped by a patient upright in interior space 12. A hand grip 44 helps a patient to brace him or herself within walking aid 10 and can be used to urge the patient's back against upper back members 4 and 42.

Figure 4:
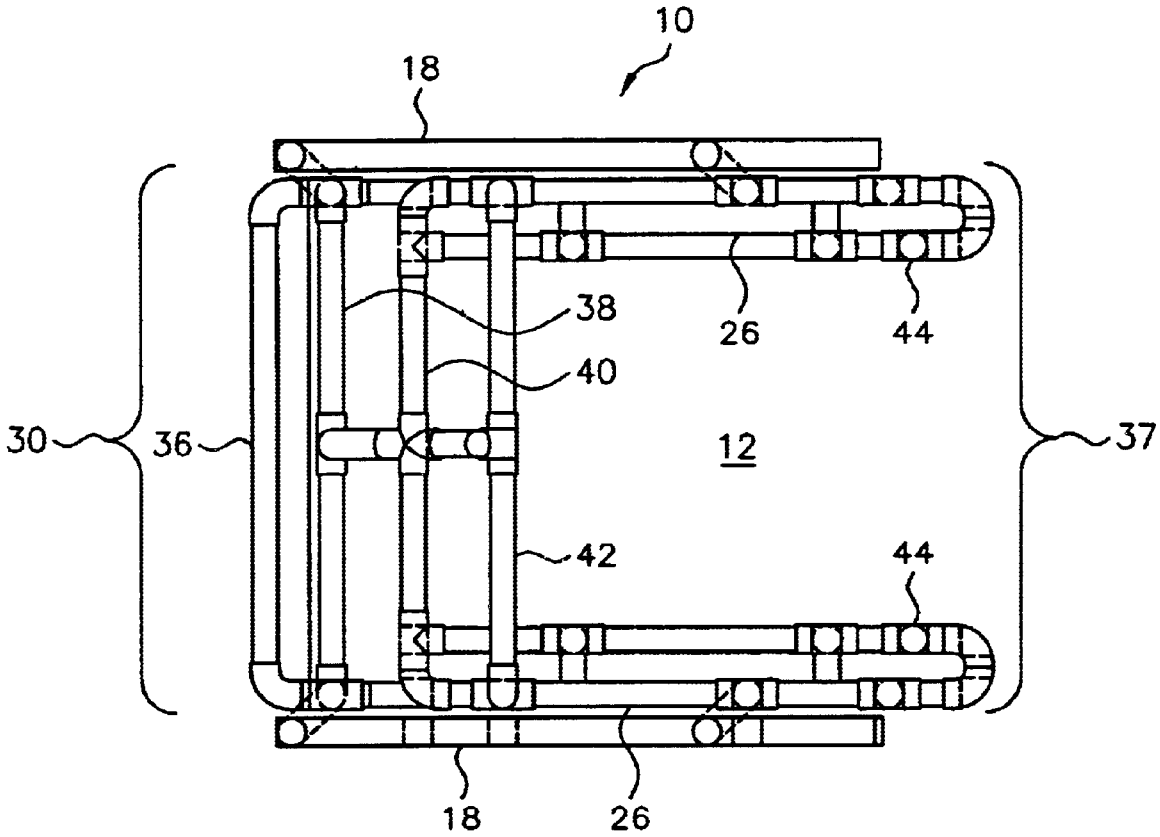
FIG. 4 is a top view of the therapeutic walking aid illustrated in FIG. 1.

As is most clearly illustrated in the top view of FIG. 4, the frame of walking aid 10, when viewed from the top, defines a substantially U-shaped configuration that surrounds the patient therein. The front portion 37 of the frame of walking aid 10, which corresponds to the top of the "U", is open without any obstruction between arm supports 26 so as to permit ingress and egress of a patient into and out from the interior of walking aid 10. Accordingly, a patient that is held in an upright position by available personnel can be positioned within the interior 12 of walking aid 10 by advancing the walking aid 10 forward to surround the patient. The patient can be removed by retracting the walking aid 10 in the same manner. Alternatively, while supported, a patient can be guided by personnel into interior 12 of walking aid 10 while walking aid 10 remains stationary. The patient can be removed from walking aid 10 in the same manner at the end of a therapeutic session.

As can be seen from general reference to FIGS. 1–4, elongated leg members 24 have bent portions along the leg length extending between supports 20 of base portion 14 and the connection between elongated leg members 24 and the handholds 32. The bends in leg members 24 serve several functions. Primarily, they make it possible to use a broader base portion 14 to increase the stability of walking aid 10 in order to provide better support to the patient as well as to reduce the tendency of walking aid 10 to tip over forwardly, rearwardly or to either side. Referring specifically to FIG. 2, it will be seen that the bends in elongated leg members 24 permit the use of a base portion 14 that is significantly wider than the interior-space 12 at a location between the arm supports 26. In other words, the distance between side portions 28 at the elevation of arm supports 26 is less than the distance between side portions 28 at the base portion 14. Accordingly, the upper portion of the frame of walking aid 10 can closely surround the patient's upper body. At the same time, the tower portion of the frame and the base portion 14 can provide the walking aid 10 with a broader stance. The difference in size of the interior space 12 at a location between arm supports 26 as compared to the distance between elongated side members 18 of base portion 14 is also illustrated in FIG. 4.

As is best illustrated in FIG. 1, the bends provided in elongated leg members 24 also shift the upper portion of the frame of walking aid 10 forwardly toward a front portion of the frame in order to improve the center of gravity of walking aid 10. More specifically, the bends in leg members 24 shift the center of gravity of walking aid 10 forwardly with respect to base portion 14 so as to reduce the tendency of walking aid 10 to tip over backwards. Because walking aid 10 is sized and shaped to accommodate even full grown adults in the upright position, the center of gravity of the device must be considered because the critical upper portion of the frame will be spaced a substantial distance from, and at a substantial elevation above, floor surface 16. Preferably, the lower ends of leg members 24 can be adjusted in the supports 20 of base portion 14 in order to adjust the height of the walking aid to accommodate shorter or taller patients for a custom fit.

Also, as is best illustrated in FIG. 1, the upper portion of back portion 30 is inclined forwardly between cross bar 38 and upper back member 42. This segment of back portion 30 provides structural support for walking aid 10 and also provides a straight surface against which the back of a patient can be supported. As will be understood, because a patient is supporting him or herself against arm supports 26 and handgrips 44, the patient's back can therefore be positioned against back members 40 and 42 of the upper portion of back portion 30. As is perhaps best illustrated in FIG. 4, each arm support 26 is most preferably formed from a pair of elongated members in order to provide a wider foundation against which a patient's arm and elbow can be supported. Also, as is shown in all of FIGS. 1–4 relating to this particular embodiment, various structural members are provided in order to make the frame rigid and durable. Accordingly, additional supporting frame lengths extend between handholds 32 and arm supports 26. Additional support portions can be added as well.

Walking aid 10 can be formed using a wide variety of materials having a wide variety of shapes and configurations. Walking aid 10 as shown in FIGS. 1–4 is formed using piping components such as pipe lengths, tees, elbows, joints and end caps. In order to reduce the overall weight of walking aid 10, standard (40 or 50 PSI) PVC plumbing components can be used wherein the joints are formed using a standard adhesive and/or a plastics weld. The base portion 14 of walking aid 10 is preferably formed from steel or aluminum bar or tube components that are welded together so as to form elongated side members 18 and vertically-extending supports 20. Base portion 14 can be collapsible to facilitate transportation and storage of the walking aid. Base portion 14 provides stability to the remainder of the walking aid, which may be formed from lighter-weight materials. In the embodiment shown, the outer dimension of elongated leg members 24 is selected so as to be smaller than the inner-diameter of hollow supports 20. If desired, elongated leg members 24 (along with the remainder of the frame of walking aid 10) can be removable from supports 20 to permit separation and reconnection with respect to base portion 14. Alternatively, elongated leg members 24 can be permanently attached within supports 20.

The therapeutic walking aid according to this invention can also be formed from other polymeric or metallic materials. For example, aluminum tubing or pipe components can be substituted for the polymeric pipe components illustrated in the figures. The aluminum would be both lightweight and durable. Other equivalent materials can of course be substituted.

Also, the modular construction illustrated in FIGS. 1–4 can be replaced with an integral, one-piece construction if desired. For example, metallic components can be bent and welded together to form an integral frame. Other equivalent constructions are contemplated as well.

Another embodiment of this invention will now be described with reference to FIGS. 5–8, which illustrate side, front, back and top views of a walking aid 100, respectively. This walking aid embodiment shares many of the same features of walking aid 10 illustrated in FIGS. 1–4. The overall purpose and function of walking aid 100, as with walking aid 10, is to support a patient's upper body during a therapeutic session so that the physician, physical therapist, technician or specialist can focus his or her attention on the patient's lower body in order to pattern and train the patient to improve ambulation techniques. Walking aid 100 differs, however, in one major way as compared to walking aid 10. More particularly, walking aid 100 is specifically adapted to provide at least partial wheelchair access into the interior space defined by the walking aid's frame.

It has been discovered that patients undergoing strenuous therapy can become suddenly exhausted and collapse. The walking aid embodiment illustrated in FIGS. 5–8 overcomes this significant problem by actually permitting at least partial wheelchair access into the interior space defined by the walker's frame so that a patient can be quickly and easily transferred from the standing position to the seated position within the wheelchair. More specifically, walking aid 100 has a frame which defines a back opening at the back is portion of the frame that is large enough to accommodate a wheelchair. The wheelchair can be introduced into the walker's interior behind the standing patient and so that the patient can be gently lowered into the wheelchair and extricated from the walking aid device.

Figure 7:
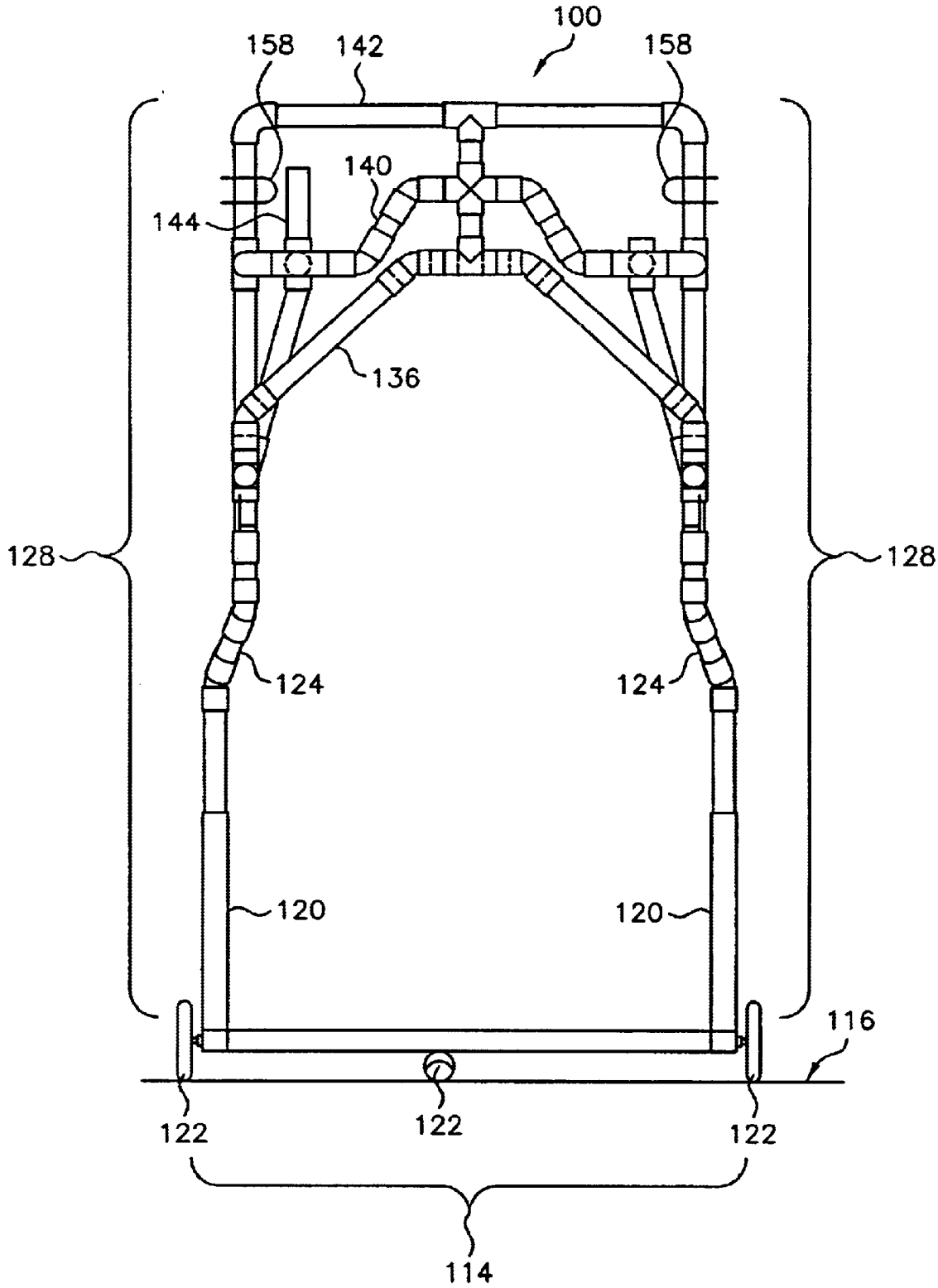
FIG. 7 is a rear view of the therapeutic walking aid illustrated in FIG. 5.
Figure 8:
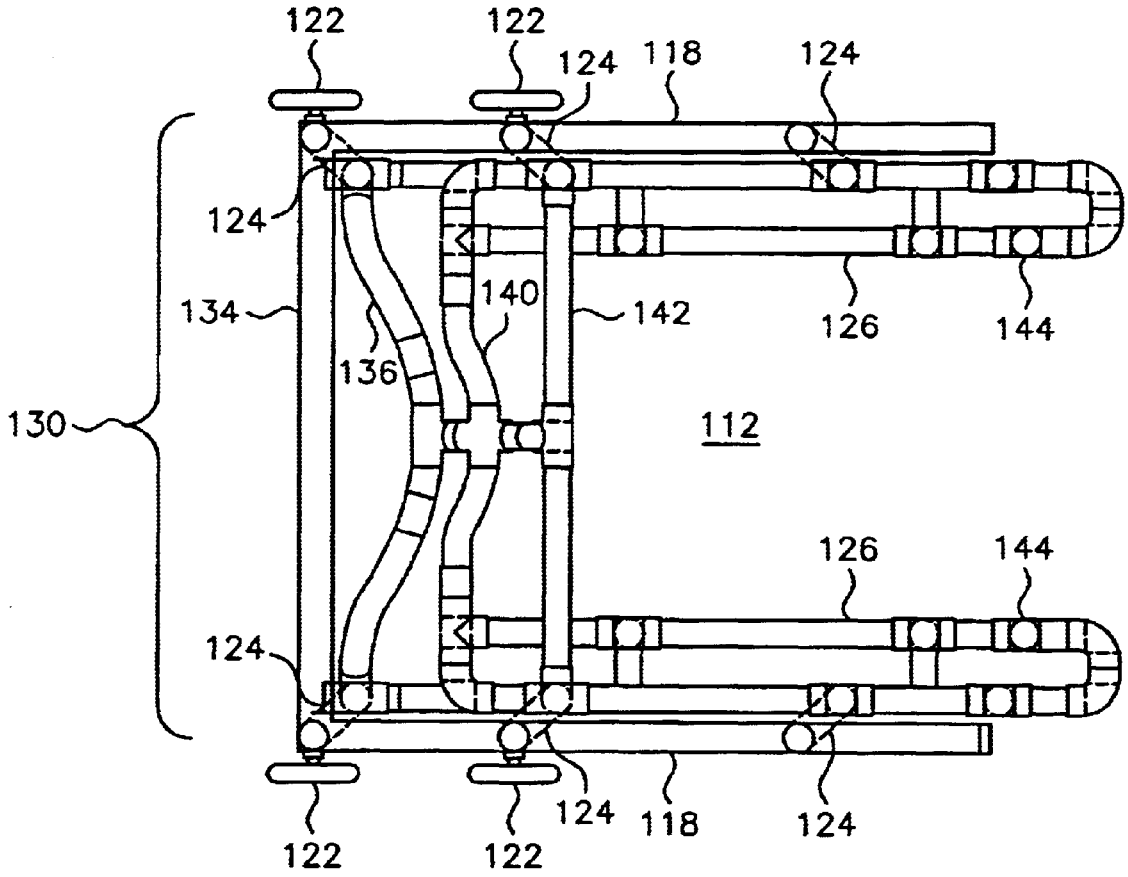
FIG. 8 is a top view of the therapeutic walking aid illustrated in FIG. 5.

Walking aid 100 has a frame defining an interior space 112 (FIG. 8). A base portion 114 of the frame includes elongated side members as well as vertically-extending supports 120 which extend upwardly therefrom. Base portion 114 also includes numerous wheels 122 in order to provide the walking aid 100 with mobility with respect to a floor surface 116 (FIG. 7). As with walking aid 10, the frame of walking aid 100 includes a plurality of upwardly extending elongated leg members 124. Extending across each side portion 128 of the frame is an arm support 126 with an outer support member 127 as well as a handhold 132. One or more handgrips 144 can be attached to the arm supports 126.

Unlike walking aid 10, walking aid 100 includes a handbrake 146 that is connected via a cable 148 to a brake pad 150. The brake pad 150 is positioned adjacent to a wheel 122 connected to the base portion 114 of the frame. In this embodiment, squeezing handbrake 146 against handgrip 144 actuates the brake pad 150 to cause frictional resistance between the brake pad and the wheel 122 so as to resist or prevent movement of walking aid 100 with respect to floor surface 116. Handbrake 146 gives the patient some degree of control over walking aid 100, and handbrake 146 acts as a safety measure to prevent runaway movement of walking aid 100.

Alternatively, or in addition to handbrake 146, walking aid 100 can be provided with an emergency brake controlled by an emergency brake lever 156 connected adjacent to a wheel 122 at base portion 114. Movement of emergency brake lever 156 can either (1) lock wheel 122 in order to prevent any rotation of wheel 122 with respect to base portion 114, and/or (2) provide emergency baking to walking aid 100 during normal use of the device. Depending on the particular positioning and size of emergency brake lever 156, the brake can be adapted for operation either by the patient within the interior 112 of the frame or by a medical professional supervising the patient during a therapeutic session. Another embodiment of the emergency brake will be described later with reference to FIG. 9.

Walking aid 100 includes a lower back member 134 that extends across the space defined between opposed supports 120. A coaster or wheel 122 is optionally provided along the length of member 134. Although back member 134 is similar in its positioning as compared to back member 34 of walking aid 10, back member 134 differs in that it is movable with respect to the frame of walking aid 100. More specifically, back member 134 can be rotated from the position shown in FIG. 6 about a pivot point at the right-hand side of back member 134 to open the back portion 130 of the frame to permit wheelchair access. In other words, by removing a pin clip closure 154 at the left hand side of back member 134, and by rotating member 134 about a pivot point at the right hand side of back member 134, a back opening is defined in the back portion 130 of the frame that extends from the floor surface 116 upwardly to the elongated back member 136 that extends to the plane of the handholds 132. The back opening thus defined provides a space into which a wheelchair (not shown) can be introduced into the interior of the frame in order to either deliver a patient into the interior or to receive and remove a patient from the interior. Accordingly, the width dimension of the space between elongated leg members 124 and supports 120 at the back portion 130 of walking aid 100 is selected in order to accommodate a standard wheelchair. When wheelchair access is not required (either after a patient has already been introduced into the interior of the walking aid or while the walking aid device is in storage), back member 134 is connected in the position illustrated in FIG. 6 so as to provide additional structural support in base portion 114. The pin clip closure 154 can be used to hold the back member 134 in place.

Attached to walking aid 100 is a support assembly 200 in order to support a patient if he or she should fall during a therapeutic session. Further details of support assembly 200, as well as a description of how it can be attached to walking aid 100, will be provided later with reference to FIGS. 10–13.

Figure 6:
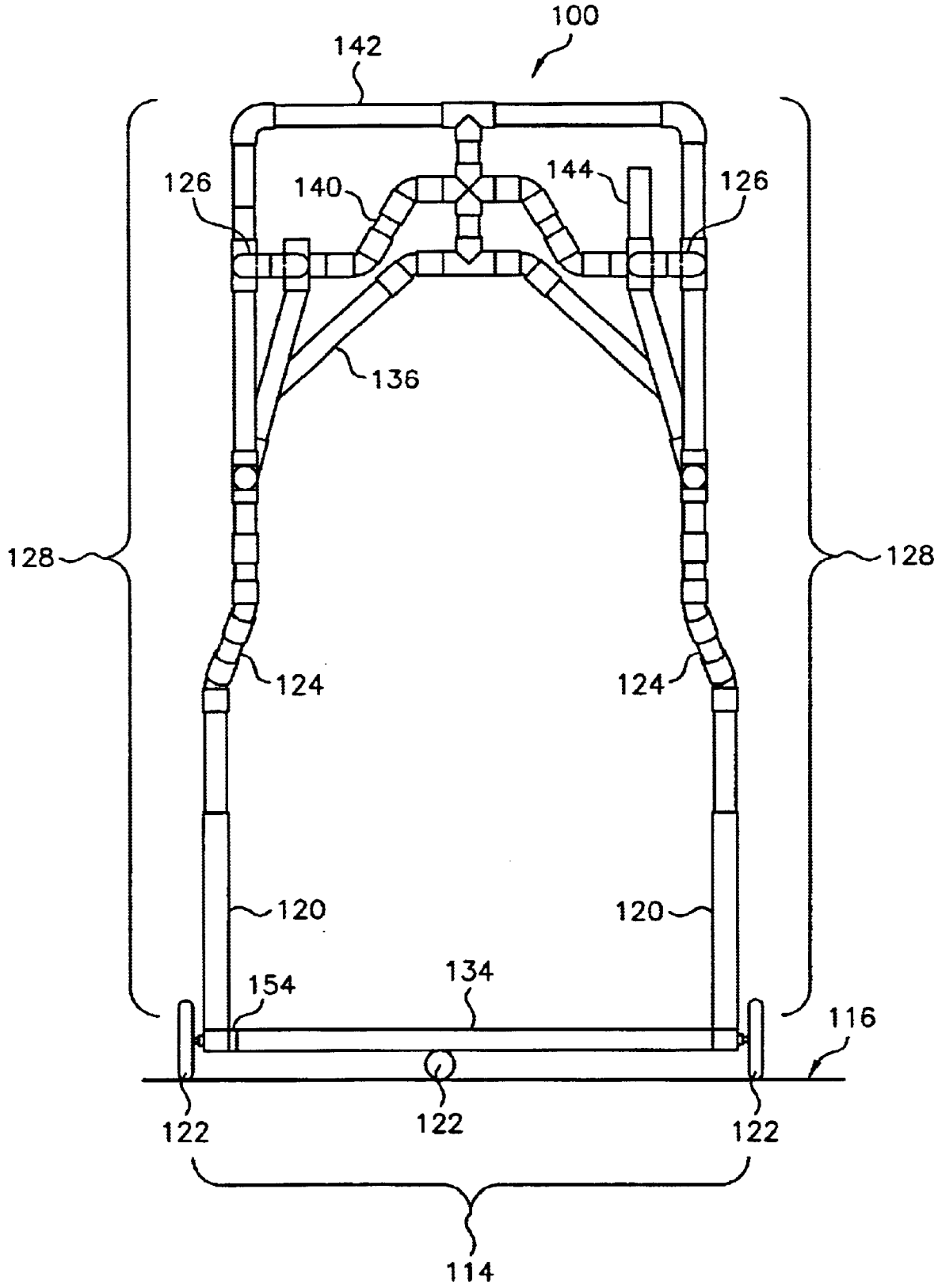
FIG. 6 is a front view of the therapeutic walking aid illustrated in FIG. 5.

It will be noted with reference to FIG. 6 that the back members of walking device 100 differ from those of walking device 10. More specifically, the elongated back member 136 that is connected at the side portions of the frame at the plane of handhold 132 is shaped so as to provide additional height to the back opening of the frame. Elongated back member 140, which is connected at the side portions of the frame in the plane of the arm supports 126, is also modified to add additional height to the back opening of the frame. It will be further noted that the elongated back member or cross bar 38 of walking aid 10 is not provided in walking aid 100 in order to remove that structural component as a possible obstruction to the back opening of the frame.

In this manner, the back opening in the frame of walking aid 100 is provided with a height that is sufficient to accommodate the passage of a wheelchair therein. The height of the back opening, which is primarily defined by the elevation of elongated back member 136, can also be selected so as to permit the passage of a seated patient in a wheelchair so that the patient can be introduced via the wheelchair through the back opening into the frame's interior, if desired, or so that the patient can be extracted from the frame's interior through the back opening. The back opening is also wide enough to accommodate a wheelchair. The distance between side portions 128 at the elevation of arm supports 126 is smaller than that at the elevation of base portion 114. This configuration permits wheelchair access into a lower portion of the walking aid while closely surrounding the patient's upper body at an upper portion of the walking aid.

It should also be noted that, like walking aid 10, walking aid 100 as shown in FIG. 8 also has a "U"-shaped configuration permitting ingress and egress of a patient from the front portion of the frame as well. Accordingly, if the elevation of elongated back member 136 is selected so that a seated patient can pass thereunder, then the patient in a wheelchair would be capable of passing all the way through the interior of walking aid 100 from back portion 130 or through the front portion 137 (FIG. 8).

Now referring specifically to FIG. 7, which provides a back view of walking aid 100, fasteners are connected at the back support portion of the frame for the connection of a chest strap that can be used to help maintain a patient in the upright position during therapeutic use of walking aid 100. Although many equivalent devices can be used in conjunction with the fasteners 158, in one embodiment a belt-like strap having a buckle can be extended between the fasteners 158 in order to urge the patient's upper body rearwardly against the elongated back members 104 and/or 142. This of course illustrates a significant benefit of the walking aids 10 and 100 according to this invention. Because at least a portion of the back support of the frame extends upwardly to an elevation above the arm supports 26, 126, it makes it possible to use a strap to help support a patient's upper body against the back support and in the upright position. Alternatively, even without the use of a strap connected to the upper back portion of the frame, the provision of a back portion that extends upwardly above the arm supports 26, 126 provides a surface against which a patient (by use of the arm supports and/or handgrips) or the patient's assistant can urge the patient's upper body into upright contact with the back support. This can be a significant advantage over conventional walkers that do not have such a back support and such a configuration is especially beneficial for use with patients who have suffered TBI or a debilitating stroke. Although a sample of a strap is not shown, it should be appreciated that conventional straps or belts can be adapted for use between fasteners 158 and that such straps can be formed from a wide variety of materials such as leather and fabric and that such straps can be made in a wide variety of shapes and configurations. The strap is preferably provided with emergency release buckles for quick release. For example, a releasable leather strap can be provided for connecting the support straps to the walking aid.

Figure 5:
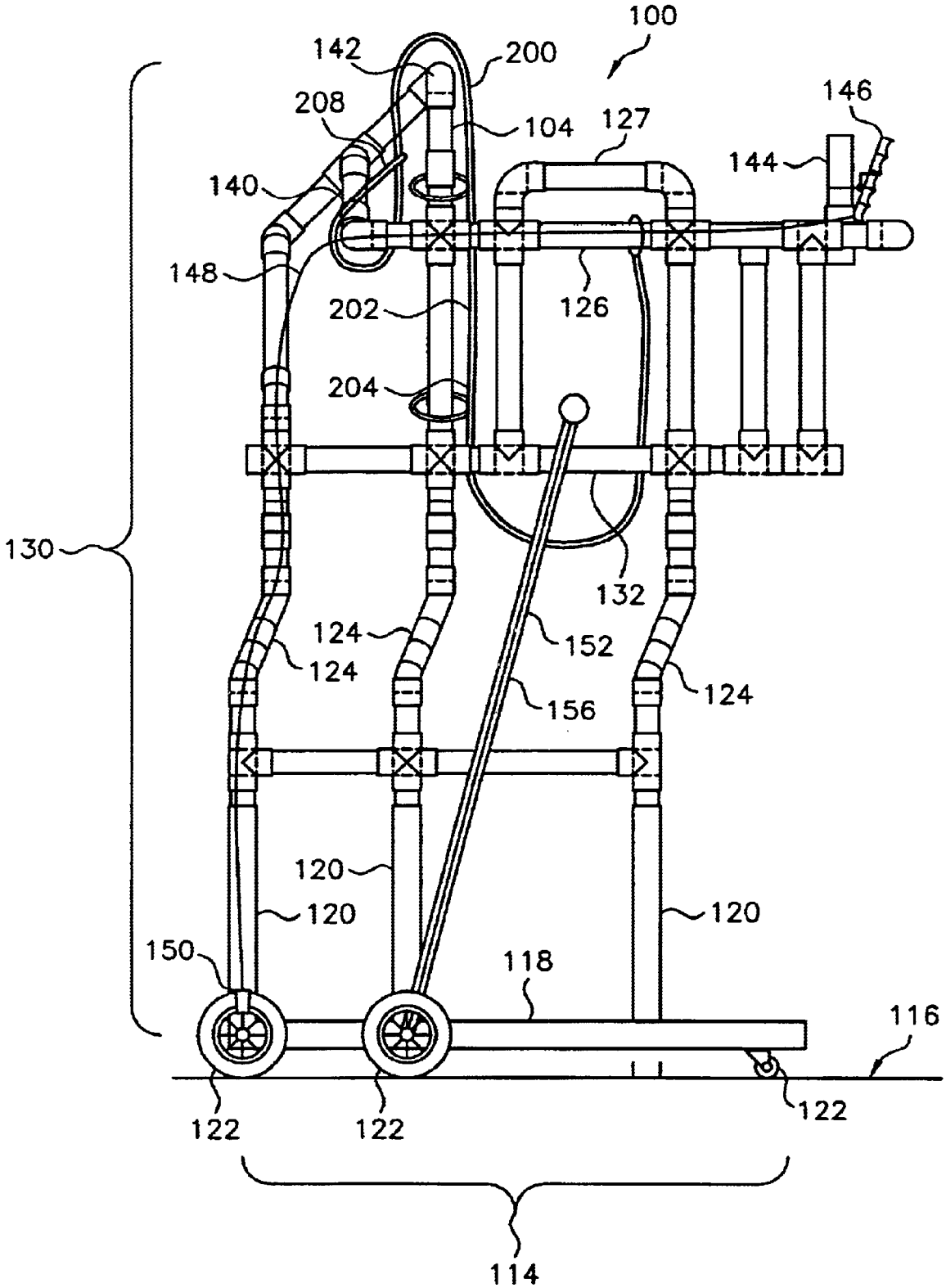
FIG. 5 is a side view of another embodiment of a therapeutic walking aid according to this invention.
Figure 9:
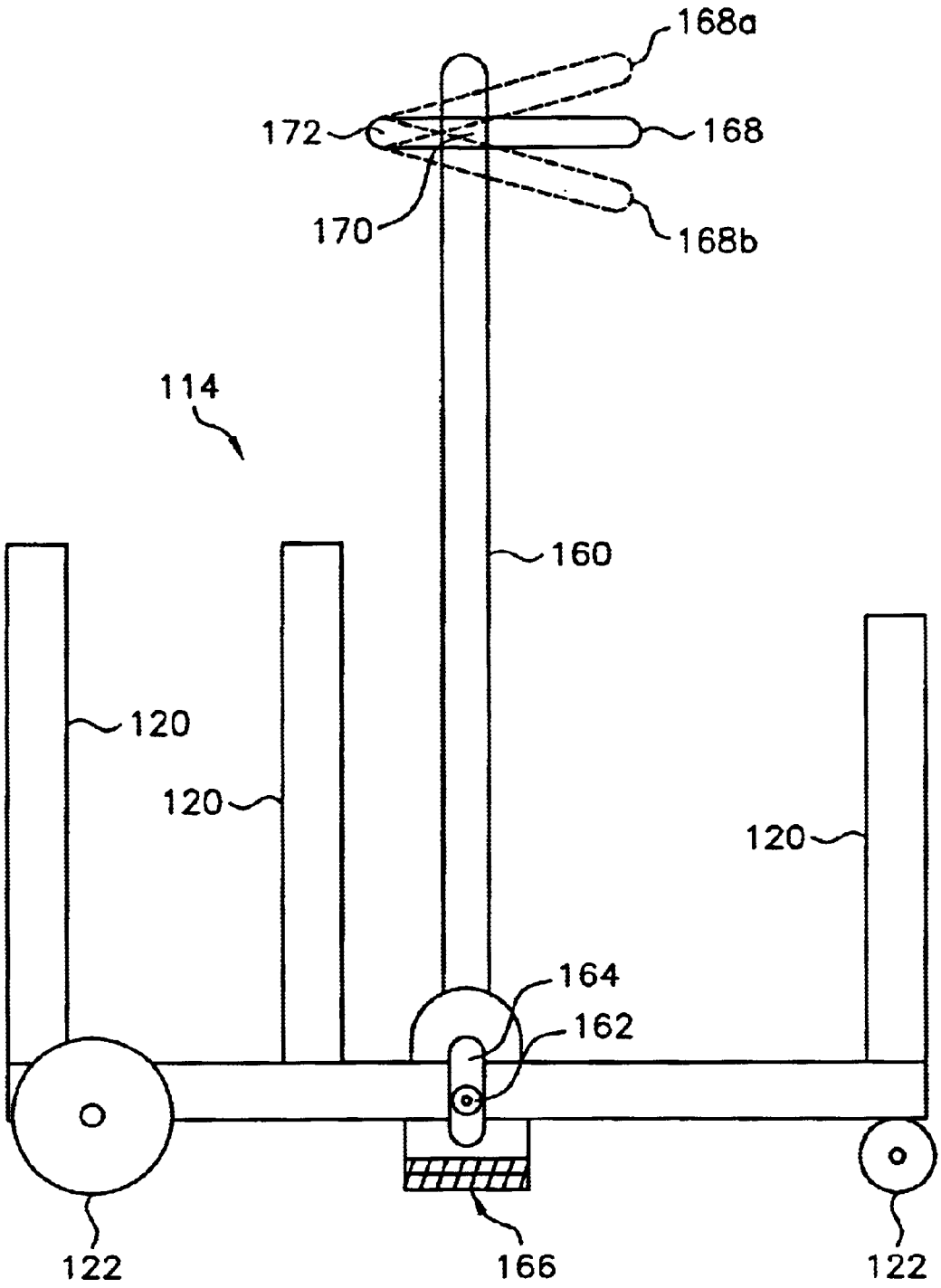
FIG. 9 is a side view of an embodiment of a base portion assembly adapted for use in a therapeutic walking aid according to this invention.

Referring now to FIG. 9, another embodiment of an emergency brake system is illustrated as a substitute or supplement to the emergency brake 152 illustrated in FIG. 5. For purposes of simplicity, only the base portion 114 of walking aid 100 is shown in FIG. 9, to which the emergency brake is connected. It has been discovered that the positioning of a wheel 122 along the length of side members 118 can compromise the movement of walking aid 100 in a circular path or around tight corners. The embodiment illustrated in FIG. 9 overcomes this limitation.

In this embodiment, the braking system includes a brake arm 160 that extends essentially vertically with respect to the rest of the frame as well as base portion 114. Toward the bottom end of brake arm 160 is provided a detent 162 that extends outwardly to the side of brake arm 160. Detent 162 extends into a slot 164 formed in base portion 114 so that detent 162 and brake arm 160 can reciprocate upwardly and downwardly within slot 164 for upward and downward movement of brake arm 160. At the bottom of brake arm 160 is attached a brake pad 166 which is adapted for engagement with a floor surface such as floor surface 116 (carpet or smooth surface). It will be appreciated that, as brake arm 160 is moved downwardly and detent 162 travels downwardly within slot 164, brake pad 166 will come into contact with floor surface 116. In this manner, movement of walking aid 100 with respect to floor surface 116 will be resisted or prevented by frictional contact.

Alternatively, lowering of brake arm 160 and brake pad 166 can be used to raise one or more wheels 122 above the floor surface 116 so as to prevent rolling motion. Accordingly, the emergency brake system illustrated in FIG. 9 is well suited for use of walking aid 100 as a stationary tool for idle rehabilitation work and for wheelchair transfers.

In order to actuate brake arm 160 to engage or disengage the brake, a lever handle 168 is provided proximal to the upper end of brake arm 160. More specifically, lever handle 168 is attached to brake arm 160 by means of a fastener 170 that permits pivotal movement of lever handle 168 with respect to brake arm 160. At an end of lever handle 168 is provided a pivot point 172 which is connected to a portion of the frame of walking aid 100 (not shown). For example, pivot 172 can be a bolt or other fastener for connection between lever handle 168 and a portion of the frame such as a handhold 132, although the manner and exact location of the attachment between lever handle 168 and the frame is not important to the invention. It will be understood that lifting of lever handle 168 to position 168*a* (shown in phantom lines) will move brake arm 160 and brake pad 166 upwardly with respect to base portion 114 for disengagement of the brake. Conversely, lowering lever handle 168 to position 168*b* (also shown in phantom lines) moves brake arm 160 and brake pad 166 downwardly in order to engage brake pad 166 with floor surface 116.

Referring now to FIGS. 10–14, several preferred components adapted for use with a walking aid according to this invention will now be described. Generally, these components are directed to safety and comfort features of the walking aid as well as to components adapted for the support of patients using the device during a therapeutic session.

Figure 10:
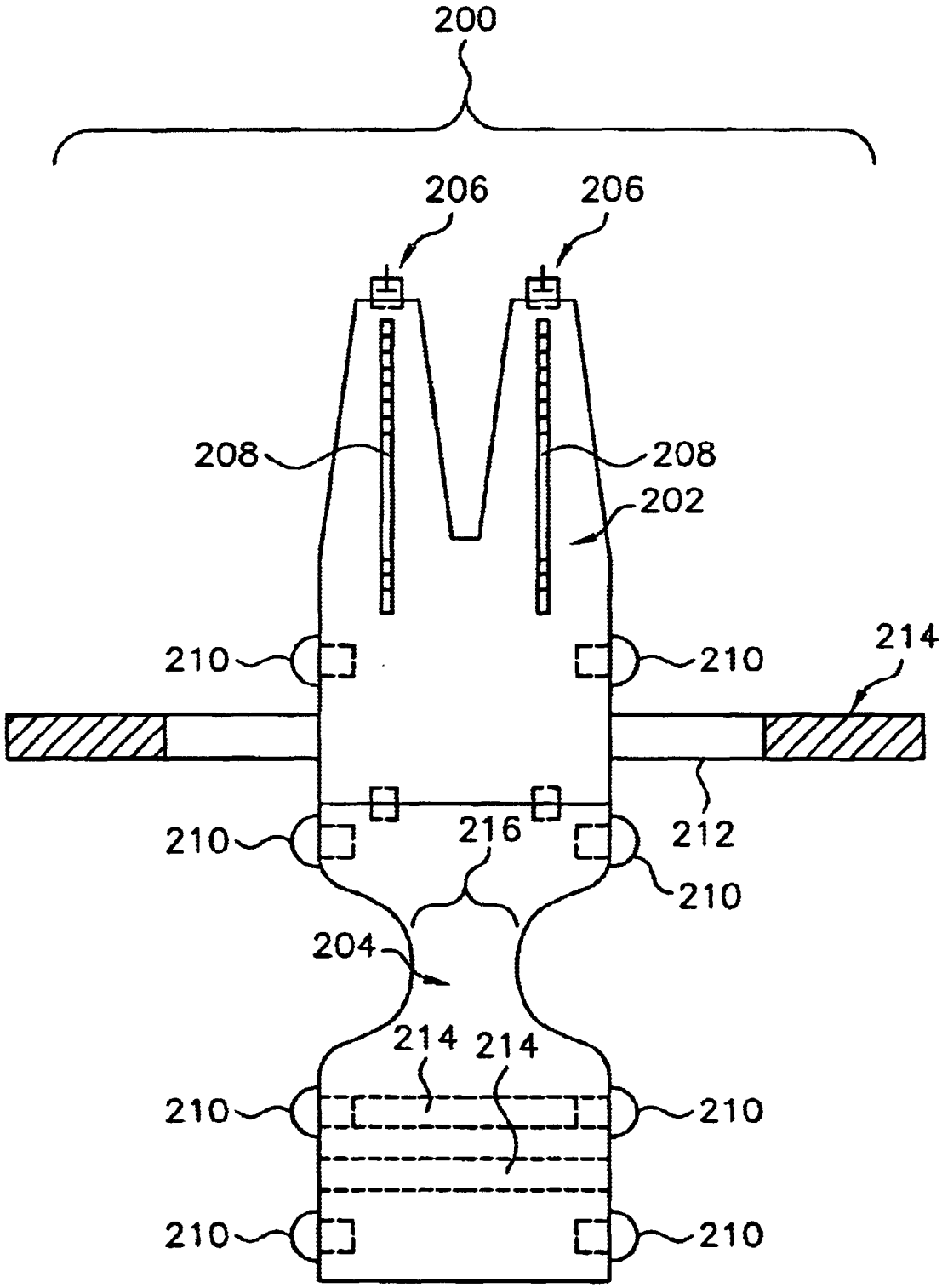
FIG. 10 is front view of a support assembly adapted for use in a therapeutic walking aid according to this invention.

Referring specifically to FIG. 10, a support assembly generally designated by the numeral "200" is configured for releasable attachment to the frame of a walking aid in order to support a patient if he or she should fall during a therapeutic session or collapse as the result of exhaustion. Support assembly 200 includes an adjustable back segment 202 as well as a front segment 204 that is releasably connected to back segment 202. Back segment 202 includes a pair of buckles 206 as well as a belt 208 with a series of buckle-engaging holes. Back segment 202 and front segment 204 both include fastening rings 210 at their sides, the purpose of which will be clarified later. Front segment 204 includes, in addition to six rings 210, several strips of hook and loop fastener 214 such as VELCRO and separate straps can be used in conjunction with the rings to accommodate quick release of the rings from the walking aid.

Figure 11:
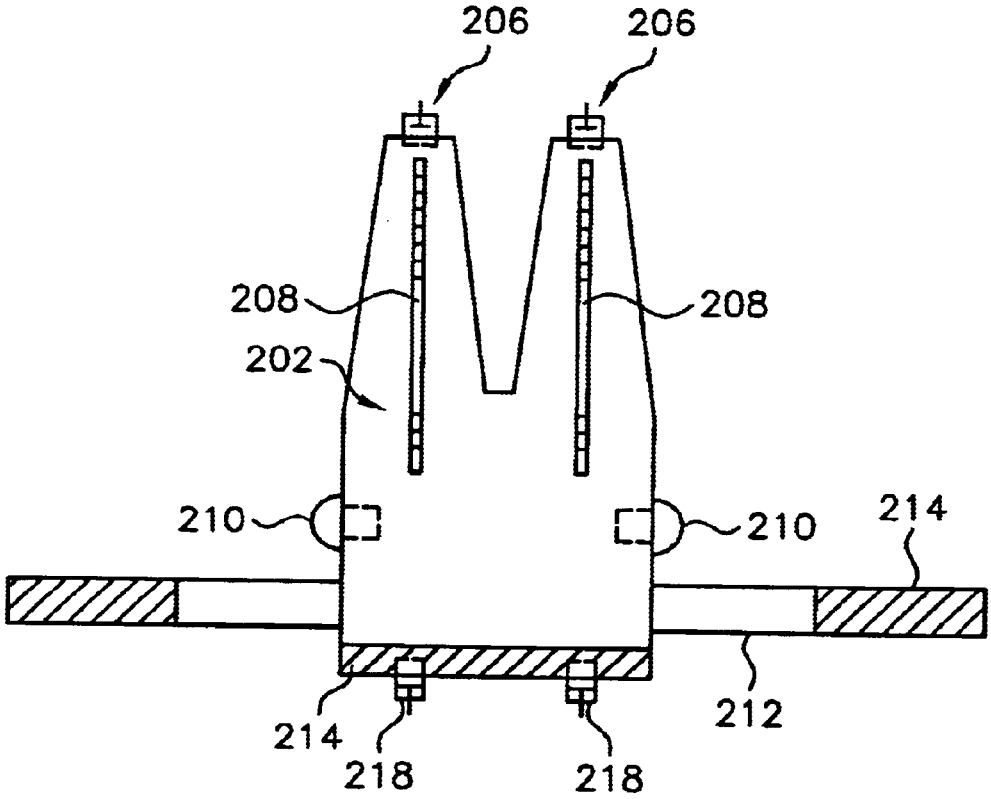
FIG. 11 is a front view of a back segment of the support assembly illustrated in FIG. 10.
Figure 12:
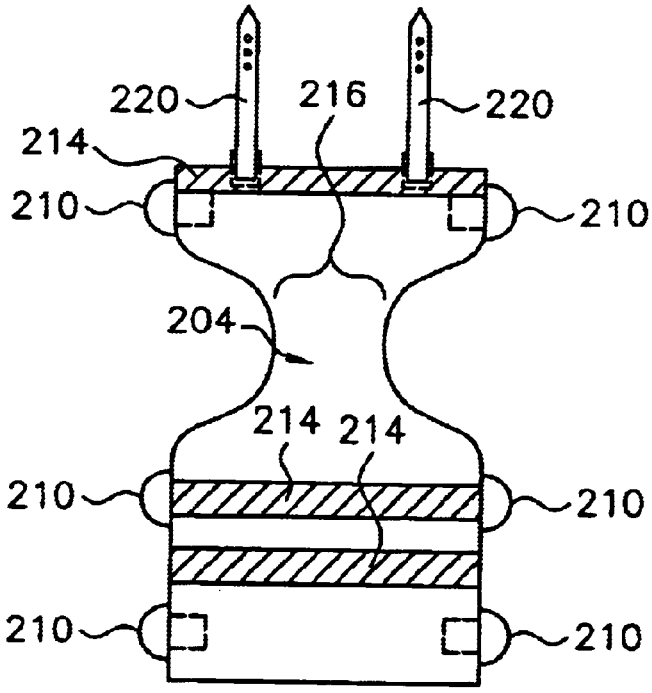
FIG. 12 is a front view of a front segment of the support assembly illustrated in FIG. 10.
Figure 13:
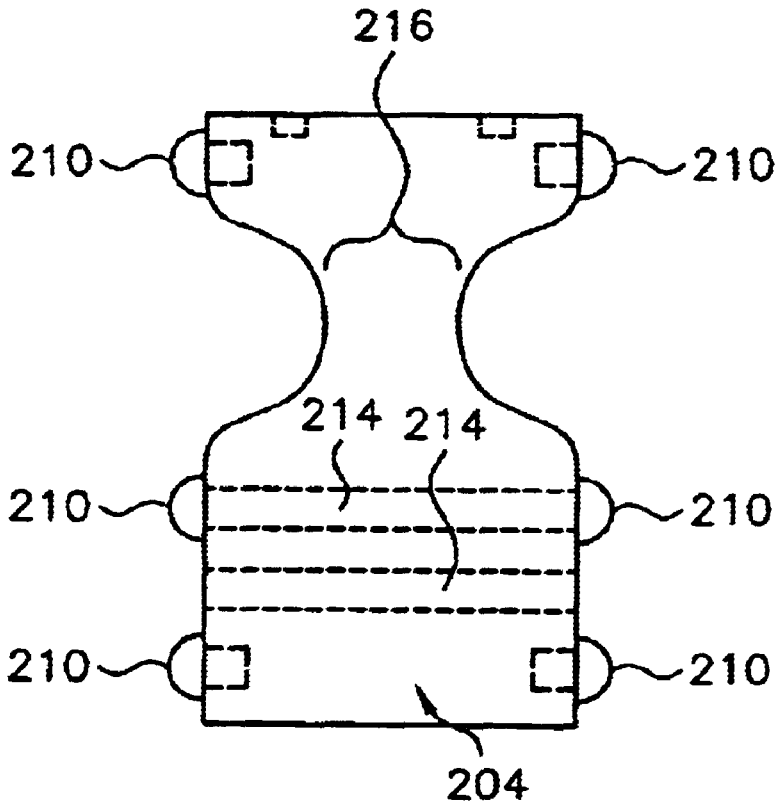
FIG. 13 is a back view of the front segment illustrated in FIG. 12.

Referring to FIG. 11, buckles 218 for engagement between back portion 202 and front portion 204 are shown as being attached to back portion 202 although they could instead be attached to front portion 204. Corresponding belts 220 with buckle-engaging holes are attached to front segment 204 as illustrated in FIG. 12. Buckles 218 and belts 220 can be replaced or supplemented with the use of mating hook and loop fastener strips along the mating edges of back portion 202 and front portion 204. In fact, such a fastener arrangement may be preferred because it can be released quickly so that a patient can be extracted from the walking aid. As illustrated in FIGS. 10, 12 and 13, front segment 204 has a narrow portion 216 with a reduced dimension "D" so that front segment 204 can fit between the legs of a patient without interfering with assisted ambulation.

A preferred manner of attaching support assembly 200 to a walking aid will now be described with reference to FIGS. 5 and 7. Although not shown, it will be readily understood that support assembly 200 can be attached to walking aid 100 by draping back segment 202 of the support assembly 200 over back members 136, 140 and 142 in such a way that the front segment 204 hangs down in front of elongated back member 142 to a point below handholds 132 and the buckle 206 and belt 208 components hang to the rear of at least one of back members 136, 140 and 142. Buckles 206 and belts 208 can then be used to releasably attach back segment 202 to either elongated back member 138 or elongated back member 140. Additional straps are preferably used to bring about engagement between frame portions and rings 210 of support assembly 200. For example, small belts can be used for this purpose. When a patient is positioned within the interior 112 of walking aid 100, the straps 212 of back segment 202 can be placed around the patient's torso and the hook and loop fasteners 214 can be engaged to hold the patient and the support assembly 200 in releasable connection adjacent to arm supports 126 and back member 142. So situated, if the patient should fall or collapse, the support assembly 200 will prevent a falling injury from occurring.

Support assembly 200 includes two pieces (202, 204) connected by straps 220 and buckles 218 and strips 214. The back segment 202 connects to the walker by draping it over back member 142, and weaving it under back member 140. The straps 208 lay over back member 140 and buckle to buckles 206. The lower support portion 204 is connected to member 124 directly above handhold 132 causing it to stay securely against the walker with slight flexibility for body movement in walking. Quick release buckles are preferably used for emergency release of the support assembly 200. Lower portion 204 is attached at arm supports 126 with metal rings 210. Rings can be selected depending on the height adjustment. A fastener 214 is also attached for engagement to the mating fastener 214 on upper segment 202.

Figure 14:
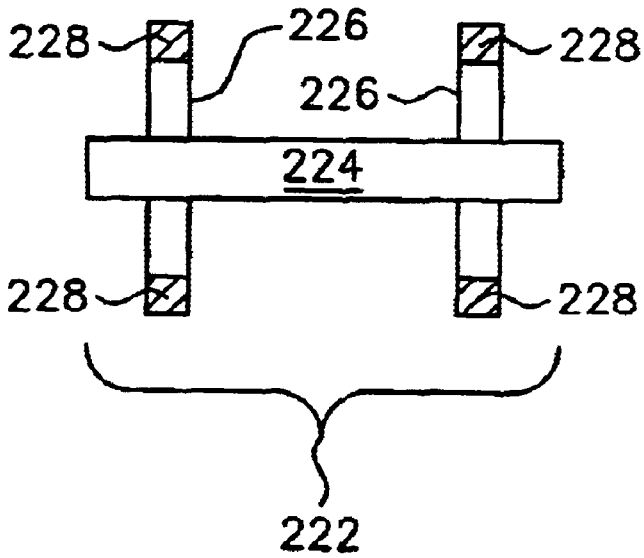
FIG. 14 is a top view of an embodiment of a pad adapted for use with a therapeutic walking aid according to this invention.

Referring now to FIG. 14, a pad assembly 222 is illustrated that is adapted for use with a walking aid according to this invention. Specifically, pad 222 is adapted for use on the arm supports of the frame for the comfort of the patient. In the embodiment illustrated in FIG. 14, pad assembly 222 includes a cushion 224 as well as a pair of straps 226 that terminate with hook and loop fasteners 228 such as those sold under the tradename VELCRO. Cushion 224 can be made of any cushioning material such as sheep skin, foam rubber and other equivalent materials. Referring again to FIG. 8, it will be understood that each pad assembly 222 can be engaged over each arm support 126 by laying the cushion 224 on the arm support 126, wrapping the straps 226 around the arm support 126, and engaging the hook and loop fasteners 228 together in order to releasably engage the pad assembly 222 to the frame.

Although this invention has been described with reference to several embodiments selected for illustration in the drawings as well as various modifications thereof, it will be appreciated that many other embodiments and additional modifications and variations can be made without departing from the spirit or scope of this invention. For example, the general configuration, materials, size and shape of the frame of the walking aid can be modified so long as it provides arm and back supports suitable to support an adult patient in an upright position during a therapeutic session. Also, various components described herein can be substituted for equivalent components and modular components can be exchanged for integral structures. The specific dimensions of the frame portion of a walking device according to this invention are not critical. In fact, it will be understood that such dimensions are advantageously selected based on the size or size range of various patients, ranging from smaller children to full-grown adults. Additional modifications of the illustrated embodiments can be made within the scope of this invention, which is defined separately in the claims that follow.

What is claimed is:

1. A wheelchair accessible walking aid comprising:

first and second spaced apart side portions defining an interior space which can be occupied by a patient in an upright position;

first and second arm supports extending along each of said first and second side portions, respectively;

a back support extending between said first and second side supports; and a back portion extending between said first and second side portions and defining a back opening shaped to permit wheelchair access into said interior space so that a wheelchair can be at least partially introduced into said interior space through said back opening to receive the patient for removal from said interior space;

said arm supports adapted to support the elbows and forearms of the patient and said back support adapted to support the upper back of the patient.

2. The walking aid according to claim 1, further comprising wheels connected to said walking aid for providing mobility of said walking aid with respect to a floor surface.

3. The walking aid according to claim 1, further comprising a handgrip removably connected to at least one of said arm supports and extending upwardly therefrom.

4. The walking aid according to claim 1, further comprising handholds extending along said first and second side portions at an elevation below said arm supports.

5. The walking aid according to claim 1, wherein the distance between said first and second side portions is larger at a location below said arm supports to permit said wheelchair access into said interior space.

6. A therapeutic walking aid adapted to support a patient in an upright position, said walking aid comprising:

first and second spaced apart side portions defining an open interior space sized to accommodate the patient, and each having an arm support adapted to support the elbow and the forearm of a standing patient; and a back portion: (a) extending between said first and second side portions, (b) having a back support extending upwardly to an elevation above said arm supports, (c)adapted to brace the upper back of a standing patient, and (d) defining a back opening sized and shaped to permit at least partial wheelchair access into said interior space;

said arm supports and said back support cooperating to support the patient's arms and upper body when the standing patient is positioned within said interior space in the upright position.

7. The walking aid according to claim 6, further comprising wheels connected to said walking aid for providing mobility of said walking aid with respect to a floor surface.

8. The walking aid according to claim 7, further comprising a handbrake for selectively preventing the mobility of said walking aid with respect to said floor surface.

9. The walking aid according to claim 6, wherein said back portion includes an elongated back member extending between said first and second side portions, said back member being moveable with respect to said walking aid so as to open said back opening to permit said wheelchair access.

10. The walking aid according to claim 6, further comprising a base portion configured to support the remainder of said walking aid with respect to a floor surface.

11. The walking aid according to claim 6, further comprising a safety support removably attached to said walking aid and positioned within said interior space of said walking aid to prevent a collapse of the patient within said interior space.

12. The walking aid according to claim 6, further comprising a handgrip connected to at least one of said arm supports and extending upwardly therefrom.

13. The walking aid according to claim 6, further comprising a strap member positioned for bracing the patient in said upright position against said back support.

14. The walking aid according to claim 6, having a substantially U-shaped configuration when viewed from above with an open front portion to facilitate ingress and egress of the patient into and out from said interior space.

15. The walking aid according to claim 6, wherein the distance between said first and second side portions is larger at a location below said arm supports to provide support and balance for larger or taller patients.

16. A wheelchair accessible walking aid comprising:

first and second spaced apart side portions defining an interior space which can be occupied by a patient in an upright position, and each having an arm support;

wheels connected for providing mobility of said walking aid with respect to a floor surface; and a back portion extending between said first and second side portions and having (a) a back support extending to an elevation above said arm supports, said arm supports and said back support cooperating to support the patient's arms and upper body when the patient is positioned within said interior space, and (b) a back member removable from said walking aid or moveable with respect to said walking aid so as to define a back opening in said back portion shaped to permit at least partial wheelchair access into said interior space so that a wheelchair can be at least partially introduced into said interior space through said back opening to receive the patient to facilitate removal of the patient from said interior space.

17. The walking aid according to claim 16, having a substantially U-shaped configuration when viewed from above with an open front portion to facilitate ingress and egress of the patient into and out from said interior space.

18. The walking aid according to claim 16, the distance between said first and second side portions being larger at a location below said arm supports to permit said wheelchair access into said interior space.

* * * * *